US005370163A

United States Patent [19]

Owen

[11] Patent Number: 5,370,163

[45] Date of Patent: Dec. 6, 1994

[54] ADJUSTABLE CONTAINER RETURN DEVICE FOR VARIABLE STROKE LIFTER SYSTEM

[75] Inventor: Barry C. Owen, Southfield, Mich.

[73] Assignee: Elopak Systems A.G., Glattbrugg, Switzerland

[21] Appl. No.: 136,708

[22] Filed: Oct. 15, 1993

[51] Int. Cl.[5] ..... B65B 43/00

[52] U.S. Cl. ..... 141/177; 141/172; 141/275

[58] Field of Search ..... 141/84, 148–152, 141/172, 177, 253, 257, 266, 275, 277, 278; 198/468.8

[56] References Cited

U.S. PATENT DOCUMENTS

| | | | |
|---|---|---|---|
| 772,195 | 10/1904 | Vogel | 141/151 X |
| 956,286 | 4/1910 | Champ | 141/152 X |
| 1,756,114 | 4/1930 | Bond | 141/266 X |
| 1,922,356 | 8/1933 | Chapman | 141/150 X |
| 1,993,367 | 3/1935 | Geyer | 222/135 |
| 2,100,359 | 11/1937 | Saeta | 141/155 |
| 2,142,257 | 1/1939 | Saeta | 141/84 |
| 2,534,997 | 12/1950 | Smith | 141/84 |
| 2,605,948 | 8/1952 | Bridge | 141/172 |
| 2,614,740 | 10/1952 | Moser | 141/172 |
| 2,896,381 | 7/1959 | Lange | 53/37 |
| 3,559,702 | 2/1971 | Riesenberg | 141/150 X |
| 4,084,626 | 4/1978 | King | 141/7 |
| 4,388,795 | 6/1983 | Stohlquist et al. | 53/435 |
| 4,712,665 | 12/1987 | McDonald et al. | 198/346.2 |
| 5,195,565 | 3/1993 | Owen et al. | 141/148 |

FOREIGN PATENT DOCUMENTS

| | | | |
|---|---|---|---|
| 0207688 | 12/1923 | United Kingdom | 141/150 |

*Primary Examiner*—J. Casimer Jacyna

*Attorney, Agent, or Firm*—Reising, Ethington, Barnard, Perry & Milton

[57] ABSTRACT

An adjustable container return device for use with a lift arm of a variable stroke lifter system for lifting variable height containers. The return device includes a vertically oriented rod threadedly movable at its bottom end relative to the lift arm; a laterally extending member operatively connected to the top end of the rod for vertical movement therewith; a retention mechanism operatively connected to said rod for retaining the laterally extending member in a selected radial direction so as to extend across an upper edge of an adjacent container; and an actuator mechanism for rotating the rod while permitting the rod to slidably move longitudinally, and thereby threadedly raising and lowering the rod relative to the lift arm, such that the laterally extending member accommodates different height containers.

14 Claims, 5 Drawing Sheets

2
42
44
66
30

18a
63
38
10
11
32
64
28
65
34
29
12
9
46
52
48
50
18b
2
18
16
14
26
18a
24
22
27
20
20

8
6
40
44
40
6
42
10
38
72
38
74
18
38
38
8
34
63
64
65
9
52
58
57
46
56
12
60
48
50
62
18
18b
18a

ADJUSTABLE CONTAINER RETURN DEVICE FOR VARIABLE STROKE LIFTER SYSTEM

TECHNICAL FIELD

This invention relates generally to variable stroke lifter systems for especially lifting containers in bottom-up liquid filling operations and, more particularly, to adjustment arrangements associated therewith for accommodating the lifting and lowering of various height containers relative to a fixed filler unit.

BACKGROUND ART

For filling containers with liquids, it is well-known to use a so-called "bottom-up" filler technique in order to eliminate the build-up of foam. In this technology, either the filler nozzle is lowered into the container and then raised during the filling operation, or the container is lifted around the filler nozzle and then lowered during the filling operation, with the two separating at a rate commensurate with the flow rate of the liquid.

When it is the container which is lifted and then lowered, it is customary to employ a system wherein either a vacuum cup or a suitable cross bar is mounted on the end of a vertical actuator for engaging the bottom surface of the container. A satisfactory vacuum arrangement is shown and described in McDonald et al U.S. Pat. No. 4,712,665.

Various cam arrangements are also known for lifting a container from a shelf or conveyor to accommodate bottom-up filling thereof as the container is lowered from around a filler nozzle, for example, Geyer U.S. Pat. No. 1,993,367; Saeta U.S. Pat. No. 2,100,359; Saeta U.S. Pat. No. 2,142,257; Bridge U.S. Pat. No. 2,605,948; Lange U.S. Pat. No. 2,896,381; King U.S. Pat. No. 4,084,626; Stohlquist U.S. Pat. No. 4,388,795; and Owen et al. U.S. Pat. No. 5,195,565.

Of the above referenced patents, one, namely, Owen et al. U.S. Pat. No. 5,195,565 discloses means for changing the lift height to accommodate different size containers; not only the stroke of a vertical, container-lifting member, but also the stroke of a vertical, container-lowering or return-member can be adjusted.

It is known that the stroke of a vertical, container-return member may be manually changed by making the member in two or more elongate parts and then manually altering the overall length of the member, using a pull-pin, hair-pin, or wing nut. However, with aseptic filling (within which is included sterile filling for the purposes of the present Specification and claims), manual access by an operator to the aseptic chamber of the packaging machine is required to perform the adjustment and this then necessitates resterilization of the chamber.

DISCLOSURE OF THE INVENTION

It is believed that the changing of the stroke of the container-return member in an aseptic chamber has been performed by a servo drive controlled from externally of the aseptic chamber by means of a computer. However, this is an expensive and complex way of changing the stroke.

A general object of the invention is to provide an improved adjustable container return arrangement for accommodating the lifting and then assisting in the lowering of various sized containers being raised and lowered by a variable stroke lifter system for a bottom-up filling operation.

Another object of the invention is to provide such an adjustment arrangement including a circumferentially fixed, vertically slidably adjustable retract-assist finger for co-operation with various height containers during the bottom-up filling operation.

Still another object of the invention is to provide a remotely adjustable carton return means, as opposed to a pull-pin or similar arrangement for which the machine must be ingressed.

A further object of the invention is to provide such an adjustment arrangement including a retract-assist finger formed on the upper end of a vertically movable rod, and one of a bevel gear mechanism or a gear box adapted to both rotate the rod and permit the rod to slide vertically therethrough.

Still another object of the invention is to provide such an adjustable arrangement wherein the bevel gear mechanism and the gear box each includes a square center opening through which a square cross-section segment of a rod is slidably mounted, with the rod including a round cross-section threadably connected for up or down movement through a threaded opening formed in a member operatively connected to a lift arm.

These and other objects and advantages will become more apparent when reference is made to the following drawings and the accompanying description.

BEST MODE OF CARRYING OUT THE INVENTION

Figure 1:
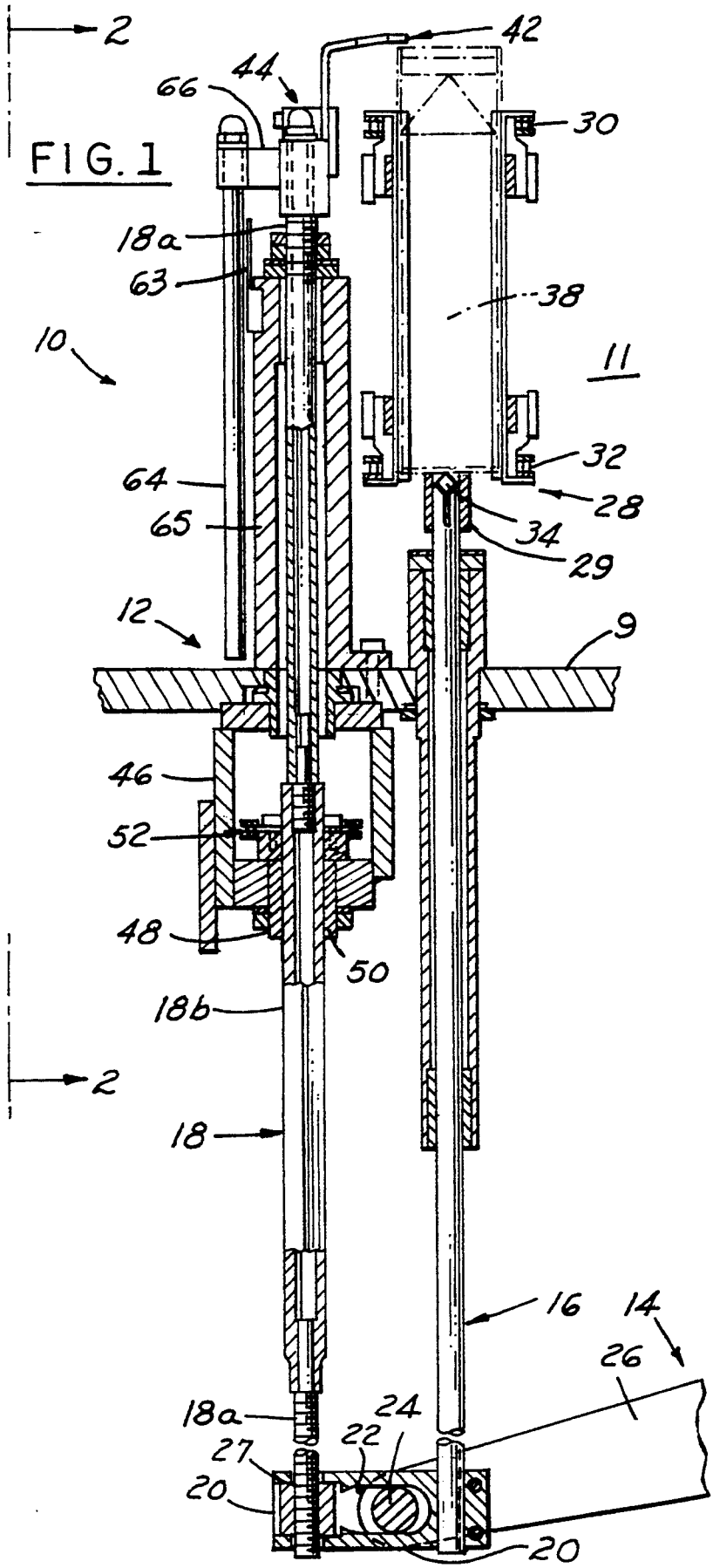
FIG. 1 is a sectional, end elevation of a variable stroke container lifter system embodying the inventive adjustment arrangement for accommodating the lifting and lowering of various height containers relative to a fixed filler unit.

Referring now to the drawings in greater detail, FIG. 1 illustrates part of a carton forming, filling and sealing machine including a bottom wall 9 bounding an aseptic chamber 11, and a multiple position container return system 10, including an adjustment device 12. The system 10 and device 12 are adaptable for use with a variable stroke container lifter system, a portion of which is represented at 14. The system 14 is not part of this invention and may be comparable to the variable stroke container lifter system illustrated and described in Pat.

No. 5,195,565, assigned to the assignee of this application.

The system 10 includes a pair of parallel rods 16 and 18 connected to, and extending upwardly from, a block 20 which is pivotally connected via a camming slot 22 formed in the center portion of the block to a suitable end segment 24 of a lift arm 26 of the lifter system 14. The rod 16 is round in cross-section for its full length, while the rod 18 is made in three segments fixed together end-to-end and is round in cross-section at its lower and upper segments 18*a*, and square in cross-section at its intermediate segment 18*b*. The lower round segment 18*a* is threadedly connected to a threaded opening 27 formed in the block 20.

A container indexing device (driving means not shown), represented at 28, may be pairs of upper and lower chains 30 and 32 with corresponding drive lugs formed thereon. Container bottom guides 29 may be vertically positioned by any suitable external means (not shown) to suit different container heights. A lift bar 34 is fixedly mounted by any suitable means, at the upper end of the rod 16, to coordinate with the position of the carton guide 29. The lift bar 34 is adaptable to engage the bottom surface of a container 38 to raise same to a position around a filler nozzle 40 (FIG. 2) to fill the container by the so-called bottom-up technique, i.e., lowering the container 38 from around the filler nozzle during the filling operation at a rate commensurate with the flow rate of the liquid. The nozzle 40 is not shown in FIG. 1 since FIG. 1 illustrates the system 10 in its down position, whereas FIG. 2 shows the system 10 in an up operational position.

Figure 6:
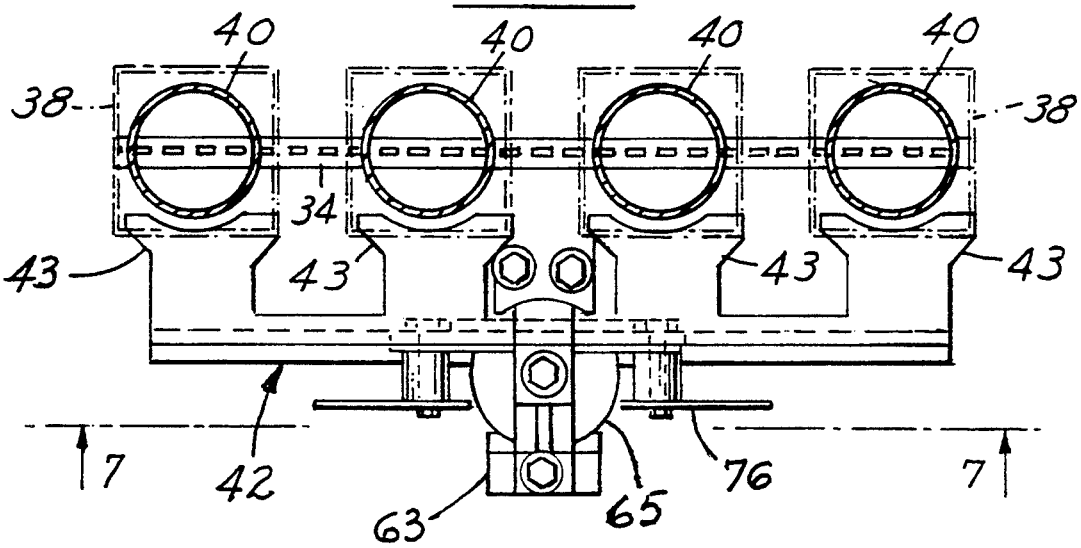
FIG. 6 is a cross-sectional view taken along the plane of the line 6—6 of FIG. 2 structure, and looking in the direction of the arrows.
Figure 7:
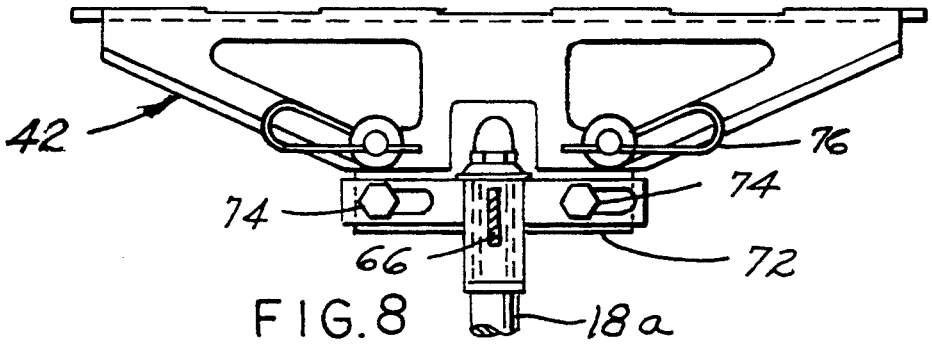
FIG. 7 is a sectional, side elevation taken along the plane of the line 7—7 of FIG. 6, and looking in the direction of the arrows.

A retract-assist laterally extending member 42 is mounted at the upper end of the rod 18, adaptable to engage the upper edge of the container 38 while it is being lowered by the lift arm 26. As illustrated in FIGS. 2, 6 and 7, the member 42 and the lift bar 34 may accommodate multiple containers, such as the four shown, by having four fingers 43. It is apparent from FIGS. 1 and 2 that, as the heights of the containers 38 change, the distance between the lift bar 34 and the member 42 must change. The height of the member 42 is adjusted for the particular container heights by the adjustment device 12. The member 42 is held in its circumferentially oriented position by a suitable anti-rotation device 44.

Figure 2:
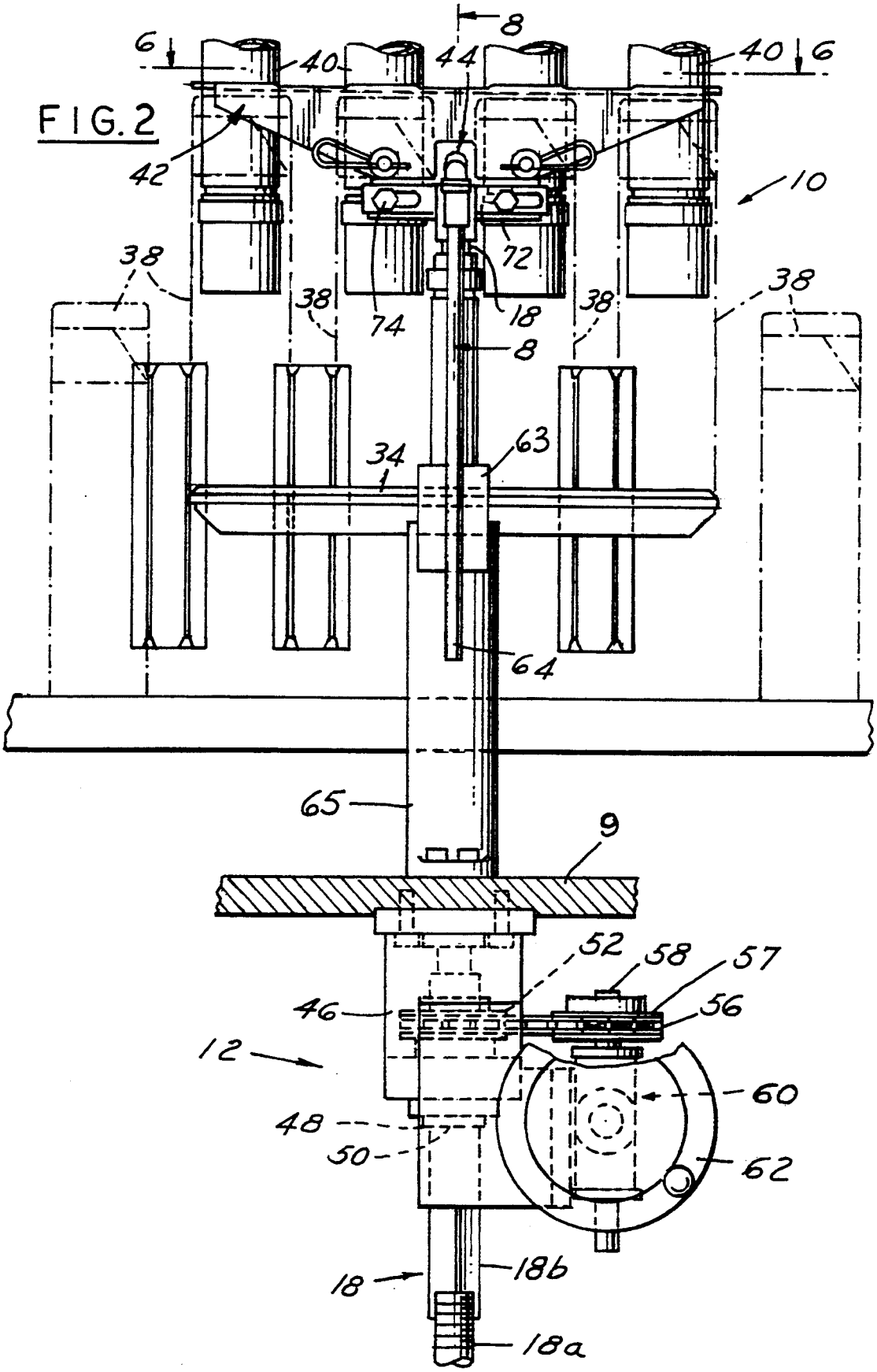
FIG. 2 is sectional, side elevation taken along the plane of the line 2—2 of FIG. 1, and looking in the direction of the arrows.
Figure 3:
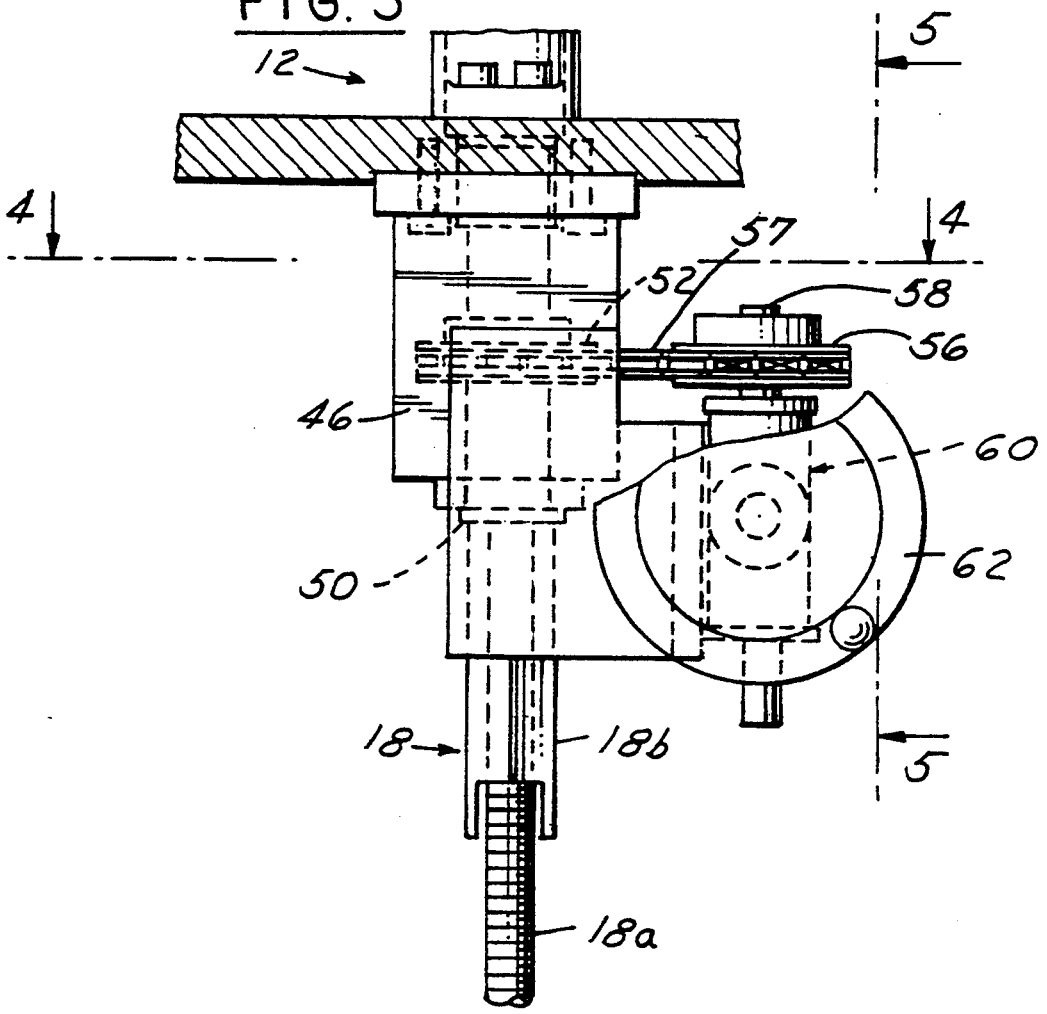
FIG. 3 is an enlarged view of a portion of the FIG. 2 structure.
Figure 4:
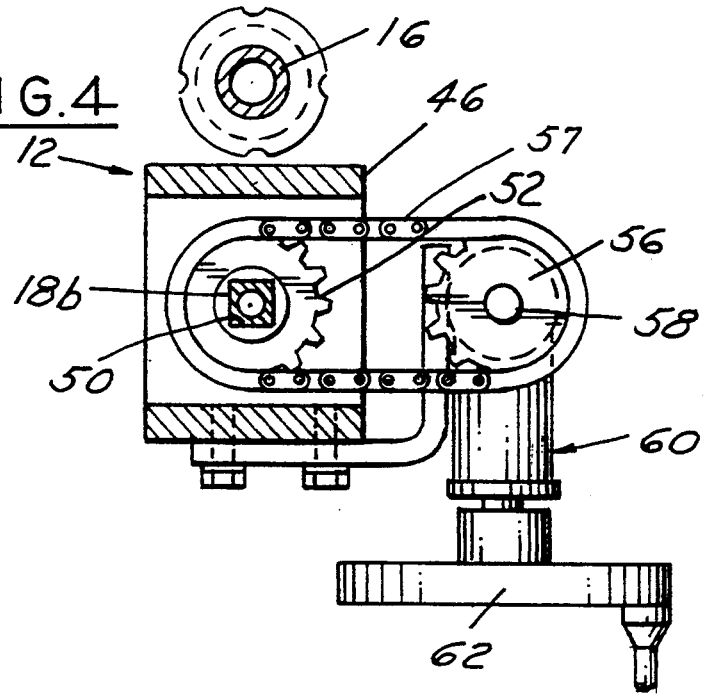
FIG. 4 is a cross-sectional view taken along the plane of the line 4—4 of FIG. 3, and looking in the direction of the arrows.
Figure 5:
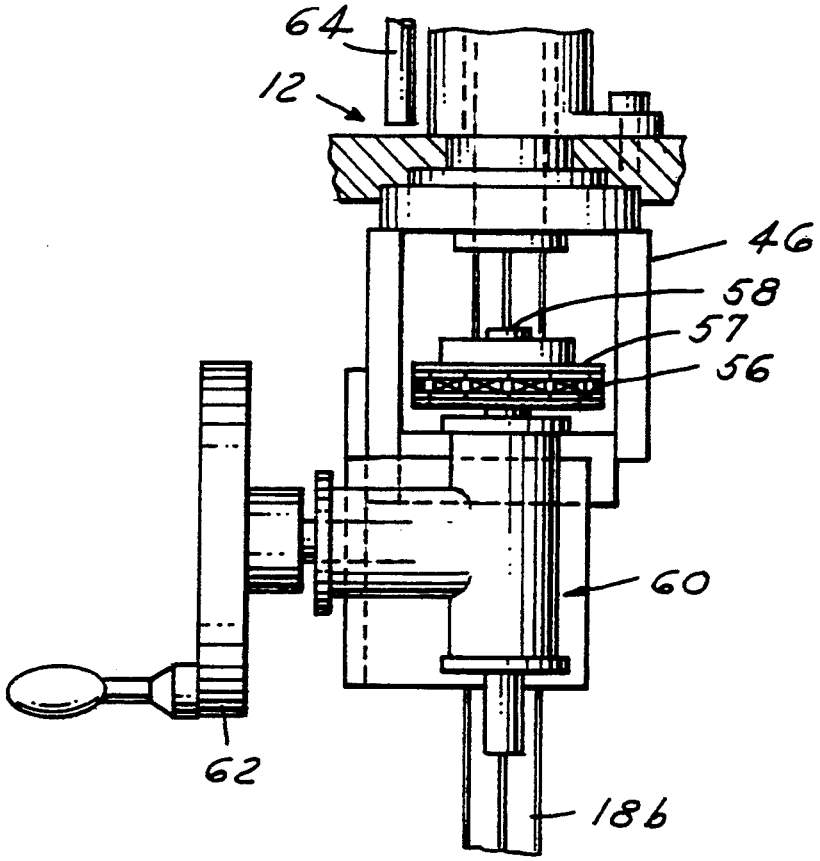
FIG. 5 is a sectional, end view taken along the plane of the line 5—5 of FIG. 3, and looking in the direction of the arrows.

As shown in FIGS. 1, 2 and 4, the adjustment device 12 comprises a housing 46 mounted externally of the wall 9 and including a bearing 48 (FIG. 1) having a square opening 50 formed therein for the extension therethrough of the square segment 18*b* of the rod A sprocket 52 is mounted directly to the bearing 48. A second sprocket 56 is connected to the sprocket 52 by a chain 57. The sprocket 56 is rotatably mounted on a shaft 58 so as to rotate with a bevel gear of a typical right-angled bevel gear drive, represented as 60 (FIGS. 2–5). The right angled drive 60 is rotated by a remote actuator mechanism, such as a handwheel 62.

Figure 8:
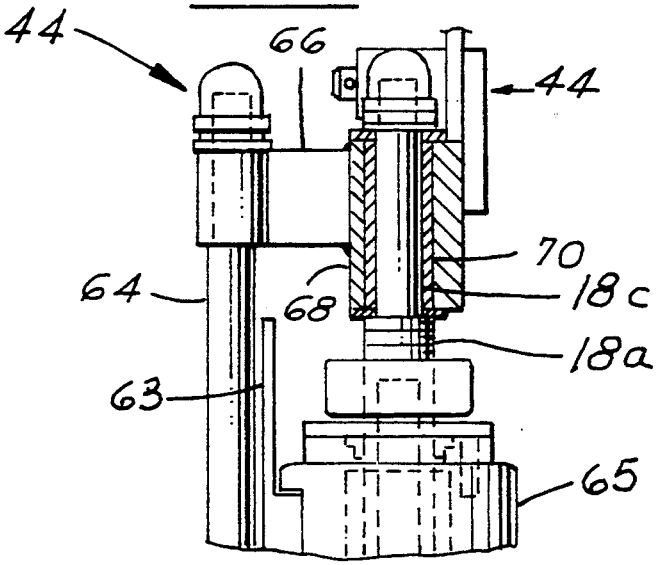
FIG. 8 is a cross-sectional view taken along the plane of the line 8—8 of FIG. 2, and looking in the direction of the arrows.

Referring now to FIGS. 6–8, the anti-rotation device 44 includes vertical, longitudinally movable but circumferentially fixed guide rod 64 having a first bracket 66 extending therefrom to a sleeve 68 housing a bearing 70 mounted around a small diameter extension 18*c* of the upper rod segment 18*a*. To prevent the rod 64 from performing significant circumferential movement about the rod 18, a vertical plate 63 is positioned immediately adjacent the rod 64. The plate 63 is fixed to a vertical sleeve 65 encircling the rod 18 and fixed to the wall 9.

As shown in FIGS. 6 and 7, a second bracket 72 is connected to the sleeve 68. The bracket 72, turn, is secured by bolts 74 to the retract-assist laterally extending member 42. The member 42 may be quickly removed from the bracket 72 for cleaning purposes by utilizing hairpins 76.

In operation, once adjustments are made to the lift bar 34 to accommodate the lifting of a different size container 38, the handwheel 62 is manually rotated to thereby rotate the right-angled drive 60 which, in turn, rotates the sprocket 56.

The resultant rotation of the sprocket 56 rotates the sprocket 52 via the chain 57, serving to rotate the square segment 18*b* of the rod 18, thereby threadedly moving the lower round segment 18*a* either upwardly or downwardly in the block 20 (FIG. 1). During such vertical and rotary movements, the rotating square segment 18*b* freely slides through the square opening 50 (FIG. 1) in the bearing 48, to thereby raise or lower the retract-assist member 42 to accommodate a different height container 38.

Industrial Applicability

It should be apparent that the invention provides an efficient and easily usable adjustment system for assisting in the lowering of various height containers during a bottom-up filling operation.

It should be further apparent that the invention provides a sanitary, externally accessible adjustment arrangement eliminating the need to ingress the machine.

While but one embodiment of the invention has been shown and described, other modifications are possible within the scope of the following claims.

What is claimed is:

1. An adjustable container return device for use with a lift arm of a variable stroke lifter system for lifting variable height containers, the device comprising a vertically oriented elongate member vertically reciprocable by said lift arm, a laterally extending member operatively connected to the top end of said elongate member for vertical movement therewith, and adjusting means for raising and lowering said elongate member relative to said lift arm, such that said laterally extending member accommodates different height containers, characterized by retention means operatively connected to said elongate member for retaining said laterally extending member in a selected radial direction so as to extend across an upper edge of an adjacent container, wherein a unit of said adjusting means includes a shaped opening permitting said elongate member to slidably move longitudinally while rotating same, wherein said elongate member includes one or more flat sides along an intermediate segment thereof and having a shape fitting said shaped opening.

2. A device according to claim 1, wherein said elongate member is threadedly movable at its bottom end relative to said lift arm.

3. A device according to claim 1, wherein said adjusting means includes gear means for rotating said unit.

4. A device according to claim 3, wherein said gear means is a right-angle bevel gear drive, and said actuator means further includes a remote actuator mechanism operatively connected to said bevel gear drive.

5. A device according to claim 4, wherein a first sprocket is connected to the output end of said bevel gear drive for rotation therewith, said unit includes a bearing having a second sprocket secured thereto, and a chain mounted around said first and second sprockets.

6. A device according to claim 4, wherein said remote actuator mechanism is a handwheel.

7. A device according to claim 1, wherein said intermediate segment is square in cross-section and said shaped opening has a square shape.

8. A device according to claim 1, wherein said laterally extending member includes a plurality of fingers formed thereon for respectively accommodating a plurality of containers.

9. Apparatus comprising driving means including a substantially vertically oriented elongate member for driving a packaging element in a substantially vertical stroke, and adjusting means connected to said elongate member for adjusting said elongate member substantially vertically, thereby to adjust said stroke, characterized in that said adjusting means comprises actuating means adapted to rotate said elongate member and to permit said elongate member to move longitudinally of itself relative to said actuating means while rotating, wherein said packaging element is a container and said stroke is downward and wherein said elongate member carries on its upper end a laterally extending member, wherein said laterally extending member extends unilaterally and wherein retention means operatively connected to said elongate member retains the unilaterally extending member in a selected radial direction so as to extend over said upper end of said container for lowering said container, said retention means including a substantially vertical, longitudinally movable, elongate guide element, fixed means around said elongate member for preventing rotation of said guide element, a sleeve connected to said guide element for rotatably receiving the upper end of said elongate member and having said unilaterally extending member fixed thereto.

10. Apparatus according to claim 9, wherein said driving means further comprises a lift arm serving to reciprocate said elongate member longitudinally, said elongate member being rotatable about said longitudinal axis relative to said lift arm and longitudinally adjustable relative to said lift arm by said adjusting means.

11. Apparatus according to claim 9, wherein a segment of said elongate member is of non-circular external cross-section and said actuating means comprises a unit embracing said segment and of non-circular internal cross-section so as drivingly to engage said segment.

12. Apparatus according to claim 9, and further comprising gear means for operating said adjusting means, and a handle for operating said gear means.

13. Apparatus according to claim 9, and further comprising wall means which bounds an aseptic chamber and through which said elongate member extends.

14. An adjustable container return device for use with a lift arm of a variable stroke lifter system for lifting variable height containers, the device comprising a vertically oriented elongate member vertically reciprocable by said lift arms, a laterally extending member operatively connected to the top end of said elongate member for vertical movement therewith, and adjusting means for raising and lowering said elongate member relative to said lift arms, such that said laterally extending member accommodates different height containers, characterized by retention means operatively connected to said elongate member for retaining said laterally extending member in a selected radial direction so as to extend across an upper edge of an adjacent container, wherein said retention means includes a vertical, longitudinally movable elongate guide element adjacent a fixed sleeve surrounding said vertically oriented and reciprocable elongate member, plate means on said fixed sleeve to maintain said longitudinally movable guide element circumferentially fixed, a first bracket extending between said guide element and a sleeve having the upper end segment of said elongate member rotatably received therein, and a second bracket interconnected between said sleeve and said laterally extending member.

* * * * *